US012765702B2

(12) United States Patent
Labbe

(10) Patent No.: US 12,765,702 B2
(45) Date of Patent: Oct. 20, 2026

(54) COASTER AND METHOD OF ASSEMBLY THEREOF

(71) Applicant: Robert J. Labbe, Ballwin, MO (US)

(72) Inventor: Robert J. Labbe, Ballwin, MO (US)

( * ) Notice: Subject to any disclaimer, the term of this patent is extended or adjusted under 35 U.S.C. 154(b) by 16 days.

(21) Appl. No.: 19/057,643

(22) Filed: Feb. 19, 2025

(65) Prior Publication Data

US 2025/0280980 A1 Sep. 11, 2025

Related U.S. Application Data

(60) Provisional application No. 63/561,967, filed on Mar. 6, 2024.

(51) Int. Cl.
*A47G 23/00* (2006.01)
*A47G 23/03* (2006.01)

(52) U.S. Cl.
CPC ..... *A47G 23/03* (2013.01)

(58) Field of Classification Search
None
See application file for complete search history.

(56) References Cited

U.S. PATENT DOCUMENTS 2,989,205 A 6/1961 Yaws
3,268,198 A * 8/1966 Swett ..... A47G 19/2283 248/346.11
4,858,872 A 8/1989 Witt
5,273,182 A * 12/1993 Laybourne ..... A47G 23/03 248/346.11
6,102,352 A 8/2000 Kvalvog
D609,977 S * 2/2010 Gjonaj ..... D7/624.1
8,839,983 B2 * 9/2014 Chiou ..... B65D 25/24 220/729
8,960,626 B1 * 2/2015 Taylor ..... A47G 23/03 248/346.11
12,114,623 B2 * 10/2024 Gaczewski ..... A01G 9/04
2007/0034766 A1 * 2/2007 Thompson ..... A47G 23/03 248/346.11
2008/0258031 A1 * 10/2008 Cleaver ..... A47G 23/03 248/346.11

(Continued)

FOREIGN PATENT DOCUMENTS

GB 2484665 A 4/2012

OTHER PUBLICATIONS

International Search Report and Written Opinion mailed May 1, 2025 for corresponding PCT/US2025/016572 (10 pages).

*Primary Examiner* — Steven M Marsh
(74) *Attorney, Agent, or Firm* — Carroll, Hoette and Butscher, LLC; William Breeze

(57) ABSTRACT

Examples of the inventive subject matter described herein relate to a coaster designed to effectively manage moisture and provide stability for drinking vessels. The coaster comprises a tray-shaped bottom portion with a circular bottom wall and a cylindrical wall extending along its outer circumference. A top portion is configured to couple with or rest upon this bottom portion. The top portion features a grid of intersecting linear bodies, with spherical-shaped cutouts located midway between the intersections of these bodies. This grid defines holes that allow condensation to flow into and be collected by the tray-shaped bottom portion. The top portion is sized to fit within the bottom portion, ensuring it does not protrude above the cylindrical wall.

20 Claims, 7 Drawing Sheets

(56) References Cited

U.S. PATENT DOCUMENTS

| | | | | |
|---|---|---|---|---|
| 2010/0183814 | A1 | 7/2010 | Rios et al. | |
| 2012/0025052 | A1* | 2/2012 | Brown | A47G 23/03 248/346.11 |
| 2012/0223208 | A1* | 9/2012 | Tehensky | A47G 23/03 248/346.11 |
| 2016/0081506 | A1* | 3/2016 | Bizzarri | A47G 23/03 248/346.11 |

* cited by examiner

COASTER AND METHOD OF ASSEMBLY THEREOF

CROSS-REFERENCE TO RELATED APPLICATIONS

This application claims priority to U.S. Provisional Application No. 63/561,967 (filed 6 Mar. 2024), the entire disclosure of which is incorporated herein by reference.

BACKGROUND

Technical Field

The present invention relates to a coaster and method of assembly thereof.

Discussion of Art

Coasters may be used to support a drinking vessel, for example a can, a bottle, a glass, or the like, on a surface. The drinking vessel may produce moisture, for example condensation. The coaster may protect the surface from damage that may be caused by the moisture. The moisture may travel down to the coaster and saturate the coaster. Further, the moisture may create a clinging force between the drinking vessel and the coaster, which may cause the coaster to stick to the drinking vessel.

Therefore, it may be desirable to provide a coaster that differs from existing coasters.

SUMMARY

Examples of the inventive subject matter described herein relate to a coaster designed to effectively manage moisture and provide stability for drinking vessels. The coaster comprises a tray-shaped bottom portion with a circular bottom wall and a cylindrical wall extending along its outer circumference. A top portion is configured to couple with or rest upon this bottom portion. The top portion features a grid of intersecting linear bodies, with spherical-shaped cutouts located midway between the intersections of these bodies. This grid defines holes that allow condensation to flow into and be collected by the tray-shaped bottom portion. The top portion is sized to fit within the bottom portion, ensuring it does not protrude above the cylindrical wall.

In one variation, the top portion has an outer diameter longer than the inner diameter of the circular bottom wall. Another embodiment of the coaster includes a tray-shaped bottom portion and a top portion with a grid of intersecting linear bodies, where cutouts are formed between the intersections. These cutouts, which may be spherical, are positioned midway between the intersections and allow condensation to flow into the bottom portion. The top portion is designed to fit within the bottom portion, which includes a circular bottom wall and a cylindrical wall along its circumference. In this configuration, the top portion's outer diameter is longer than the inner diameter of the circular bottom wall, and it is shorter than the cylindrical wall.

Another example features a coaster with a top portion designed to receive a drinking vessel. This top portion includes a serrated section that engages the drinking vessel, preventing attachment when the vessel is lifted. The bottom portion is removably coupleable to the top portion and is designed to receive and store moisture. The top portion's diameter ranges between 75 millimeters and 175 millimeters, and the coaster is designed to protect furniture surfaces from temperature extremes and moisture. The top portion may include a grid surface with semi-spherical cutouts in both latitude and longitude directions, creating the serrated portion. These cutouts facilitate a capillary effect, directing moisture to a collection portion in the bottom portion, which has a volumetric capacity greater than 20 milliliters. The collection portion may include an empty bottom pan, a moisture-absorbing packet, or a color-changing absorbing packet, with the moisture-absorbing packet potentially containing silica material. The top portion can be coupled to the bottom portion via a threaded connection, snap fit, or friction fit.

Other aspects of the inventive subject matter will become apparent by consideration of the detailed description and accompanying drawings.

Before any embodiments of the inventive subject matter are explained in detail, it is to be understood that the invention is not limited in its application to the details of construction and the arrangement of components set forth in the following description or illustrated in the following drawings. The invention is capable of other embodiments and of being practiced or of being carried out in various ways.

DETAILED DESCRIPTION

The foregoing summary, as well as the following detailed description of certain embodiments will be better understood when read in conjunction with the appended drawings. As used herein, an element or step recited in the singular and preceded by the word "a" or "an" should be understood as not necessarily excluding the plural of the elements or steps. Further, references to "one embodiment" are not intended to be interpreted as excluding the existence of additional embodiments that also incorporate the recited features. Moreover, unless explicitly stated to the contrary, embodiments "comprising" or "having" an element or a plurality of elements having a particular condition can include additional elements not having that condition.

In the realm of beverage consumption, coasters have long been utilized to protect furniture surfaces from moisture and temperature-related damage. Traditional coasters, while effective in preventing direct contact between a drinking vessel and a surface, often fail to adequately manage condensation and spills. This can result in moisture accumulation on the coaster itself, which may eventually overflow and damage the underlying surface. Furthermore, many conventional coasters lack the ability to securely hold the drinking vessel, leading to potential spills and instability.

The present disclosure relates to a coaster for supporting a drinking vessel on a surface. The disclosure relates to moisture drainage and moisture absorption by the coaster to reduce adherence of the coaster to the drinking vessel. This disclosure may provide protection of supporting surface underneath the coaster and the reduction of inconvenience brought about by sticking of the coaster to any surface, such as a table, bar, desk, etc., as well as to the drink container itself.

Figure 1:
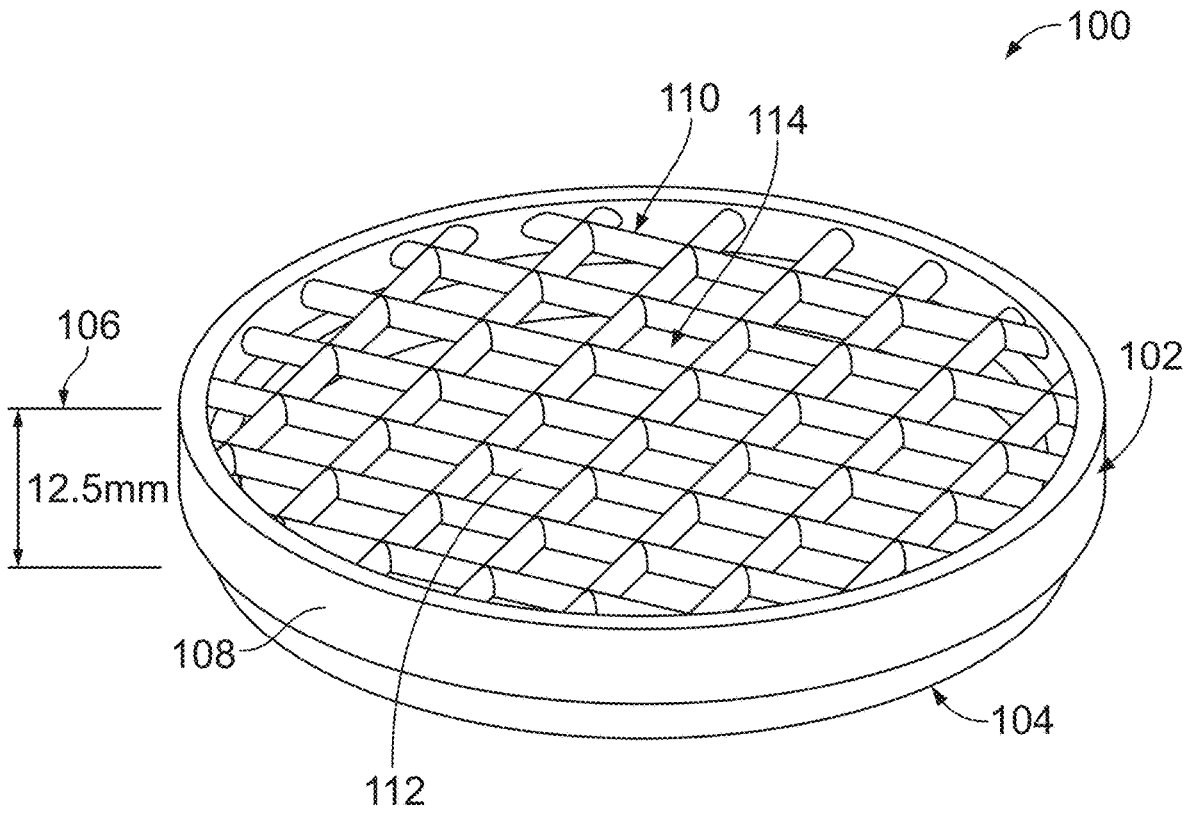
FIG. 1 illustrates one example of a coaster.
Figure 2:
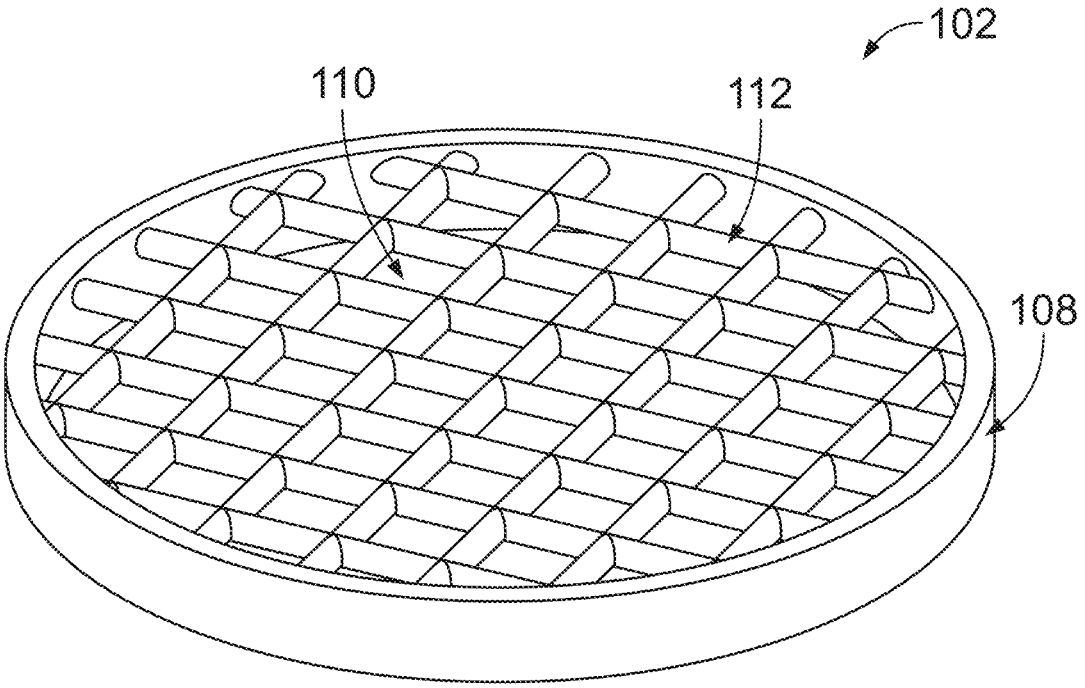
FIG. 2 illustrates a top portion of the coaster shown in FIG. 1.
Figure 3:
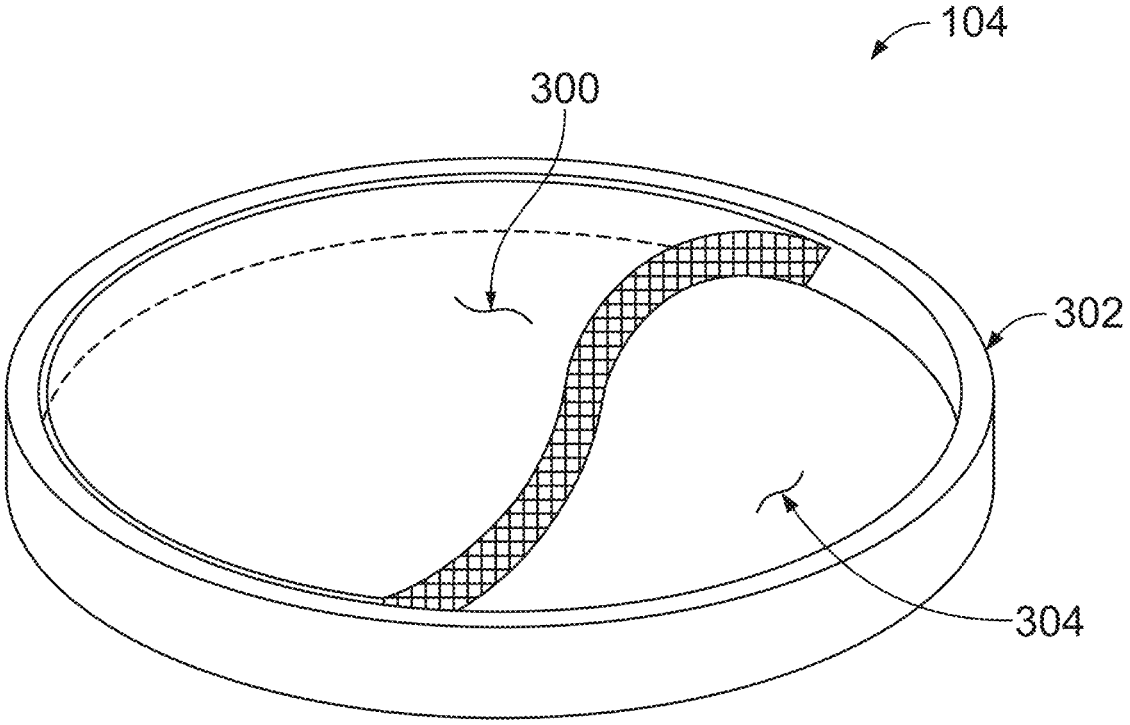
FIG. 3 illustrates a bottom portion of the coaster shown in FIGS. 1 and 2.

FIG. 1 illustrates one example of a coaster 100. FIG. 2 illustrates a top portion 102 of the coaster 100 shown in FIG. 1. FIG. 3 illustrates a bottom portion 104 of the coaster 100. The coaster 100 may receive and support a drinking vessel. The coaster 100 may prevent the drinking vessel from being placed directly on a surface, for example furniture. The coaster 100 may include a top portion 102 and a bottom portion 104. The coaster 100 may have a thickness 106. The thickness may be between 5 millimeters and 50 millimeters, such as 12.5 millimeters in one example. The top portion 102 is formed as a cylindrical wall 108 with a grid 110 formed from interlaced or crossing linear bodies 112, for example arranged in an interlaced grid. The shape and density of the grid may be modified based on desired use and/or aesthetic. The linear bodies 112 may be rounded or cylindrical bodies (e.g., bodies with a circular or rounded cross-sectional shape). Alternatively, the linear bodies 112 may have square or rectangular shapes (e.g., bodies with square, rectangle, or other polygon cross-sectional shapes). Alternatively, the bodies 112 may have shapes that is a combination of curved shapes and polygon shapes.

The coaster 100 may have a diameter that may accommodate a majority of drinking vessels. In one example, the diameter may be 102 millimeters. The coaster 100 may be designed to protect the most valuable of furniture surfaces by protecting from the surface from hot or cold temperatures and ensuring no moisture or liquid condensate contacts with furniture surface.

For example, the linear bodies 112 may be spaced apart in the grid 110 to form holes 114. The bottom portion 104 can be a tray formed with a circular bottom wall 300 and a cylindrical wall 302 extending upward from the bottom wall 300, as shown in FIG. 3. The volume bounded by the bottom wall 300 and the cylindrical wall 302 can be referred to as a collection portion or volume. The collection portion or volume may hold up to twenty milliliters of fluid before the fluid flows over the upper edge of the wall 302. Optionally, the collection portion or volume can hold more than twenty milliliters.

The top portion 102 may rest on or be coupled with the top edge of the bottom wall 300. For example, the top portion 102 may lie on, but not be fixed to, the top edge of the cylindrical wall 302 such that the top portion 102 is easily separable from the bottom portion 104. The top portion 102 and bottom portion 104 of the coaster 100 may be coupled via a threaded fit to allow easy connection of top 102 to bottom 104. The top portion 102 and bottom portion 104 may be connected via fasteners, snap fit, friction fit, or the like. As another example, the top portion 102 may be coupled with the bottom portion 104, such as using an adhesive or fasteners (e.g., the top portion 102 and bottom portion 104 may have complimentary threads that allow the top portion 102 and/or bottom portion 104 to be screwed together).

The grid 110 in the top portion 102 may be displaced or spaced apart from the bottom wall 300 due to the top portion 102 being on top of the bottom portion 104. This allows for condensation from the drinking vessel to fall into the tray formed by the bottom portion 104 between the linear bodies 112 through the holes 114. The condensation may collect in this tray and be discarded after consuming the drink. The volumetric capacity of the bottom collection pan for condensation collection may be well in excess of any drink container exterior surface, even if sweating were to occur in a 24-hour period.

Figure 12:
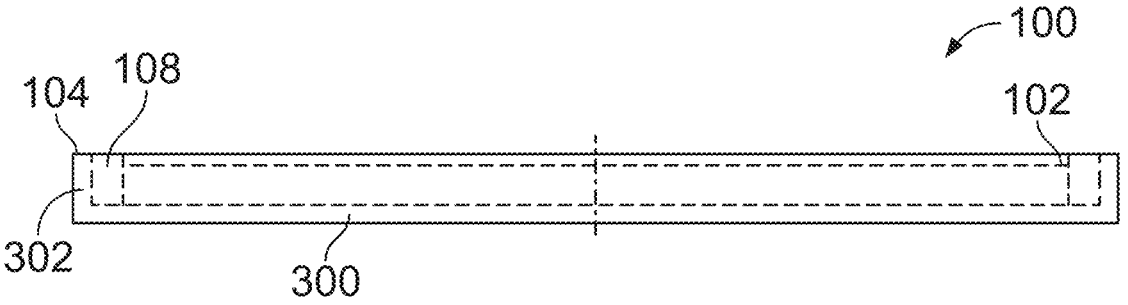
FIG. 12 illustrates an elevational view of the coaster shown in FIGS. 6 through 11 according to one example.

The coaster 100 may be functional (e.g., operate) in several modes of operation including: an empty bottom pan mode for condensate collection (where the top portion 102 is removed and just the bottom portion 104 is used as a pan or tray in which to set the drinking vessel), or a bottom pan insertion mode where moisture absorbing material 304 may be placed. The moisture absorbing material 304 may be a silica material, a repulpable material (for example paper or other fiber), or the like. The moisture absorbing material 304 can be placed into the bottom portion 104 for condensate adsorption or addition of color changing bulk beaded silica for condensate adsorption and decorative purposes. The material in which the coaster 100 is constructed may allow the coaster to be washable in a dishwasher safe environment. For example, the coaster 100 may be made from a plastic or other polymer, metal, wood, repulpable material, recycled material, or the like. The coaster 100 may be 3D printed or additively manufactured, die injection molded, or the like. The coaster may be made in any desired color or pattern. The coaster may be designed to allow insertion of signature personalization, professional, commercial or any entity logo advertising. For example, logos, text, images, or the like, may be printed on or formed in the top portion 102 and/or the bottom portion 104. The coaster 100 is designed to fit into 2, 4, 6 and 8 quantity holder for ease of handling and storage, as shown in FIG. 12.

Figure 4:
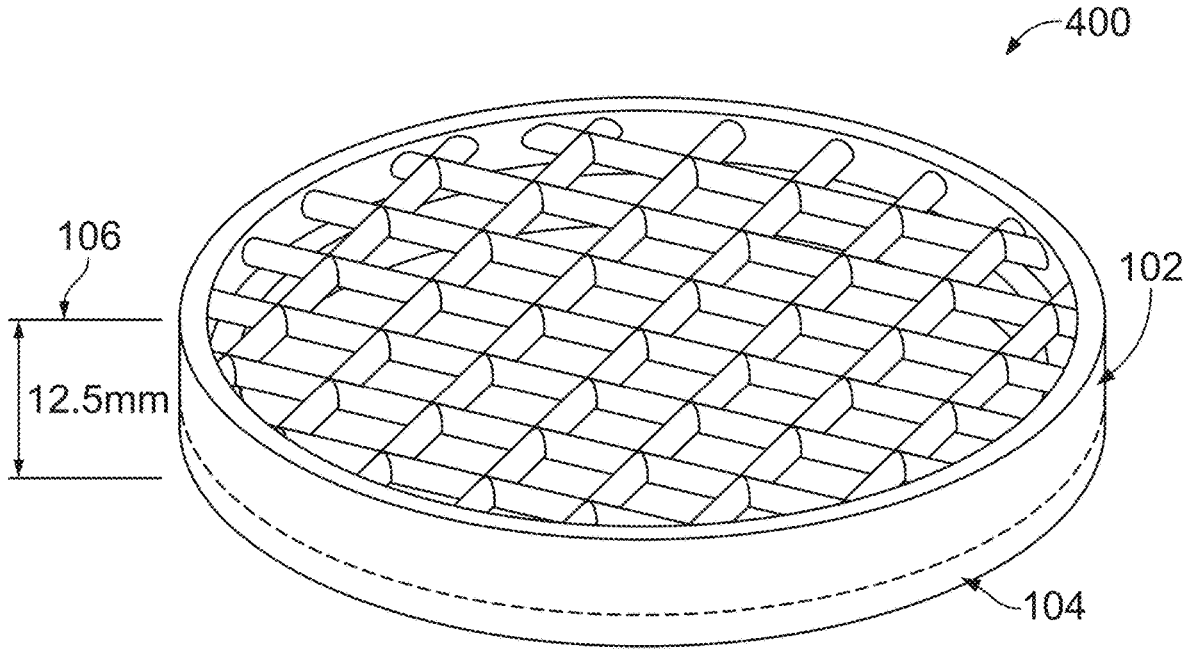
FIG. 4 illustrates a coaster according to another example.

FIG. 4 illustrates a coaster 400 according to another example. The coaster 400 may be a single unit construction. The top portion 102 and the bottom portion 104 may be a single unit (e.g., with no seams or interfaces therebetween) or may be fixedly coupled with each other.

Figure 5:
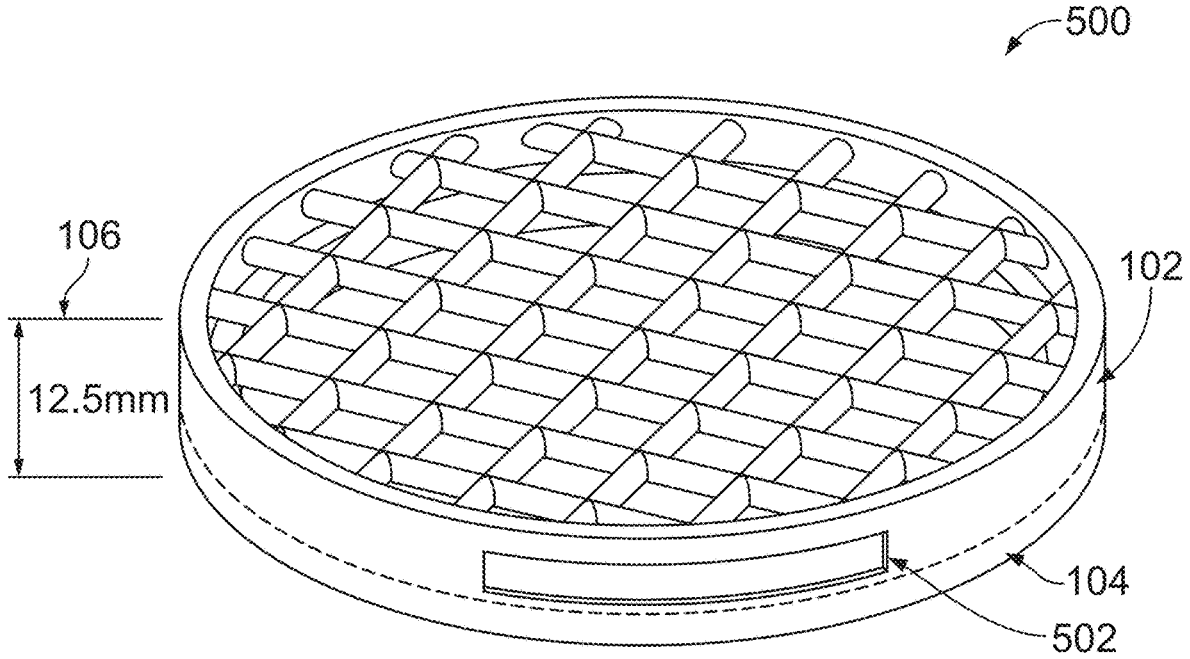
FIG. 5 illustrates a coaster according to another example.

FIG. 5 illustrates a coaster 500 according to another example. The coaster 500 may be a single unit construction similar to the coaster 400. Said another way, the top portion 102 and the bottom portion 104 may be a single unit and may be fixedly coupled. The bottom portion 104 of the coaster 500 may include a slot 502 or other opening. The slot or opening 502 may extend through the entire thickness of the circular or cylindrical wall 302 in the bottom portion 104. The slot or opening 502 may receive a moisture absorbing insert formed from or including the material 304. The moisture absorbing insert may be a gel or beads, for example a silica gel or silica beads. In other examples, the moisture absorbing insert may be another material. Optionally, the slot or opening 502 may provide an outlet for condensation collected in the bottom portion 104 to be dumped out of the coaster 500.

Figure 6:
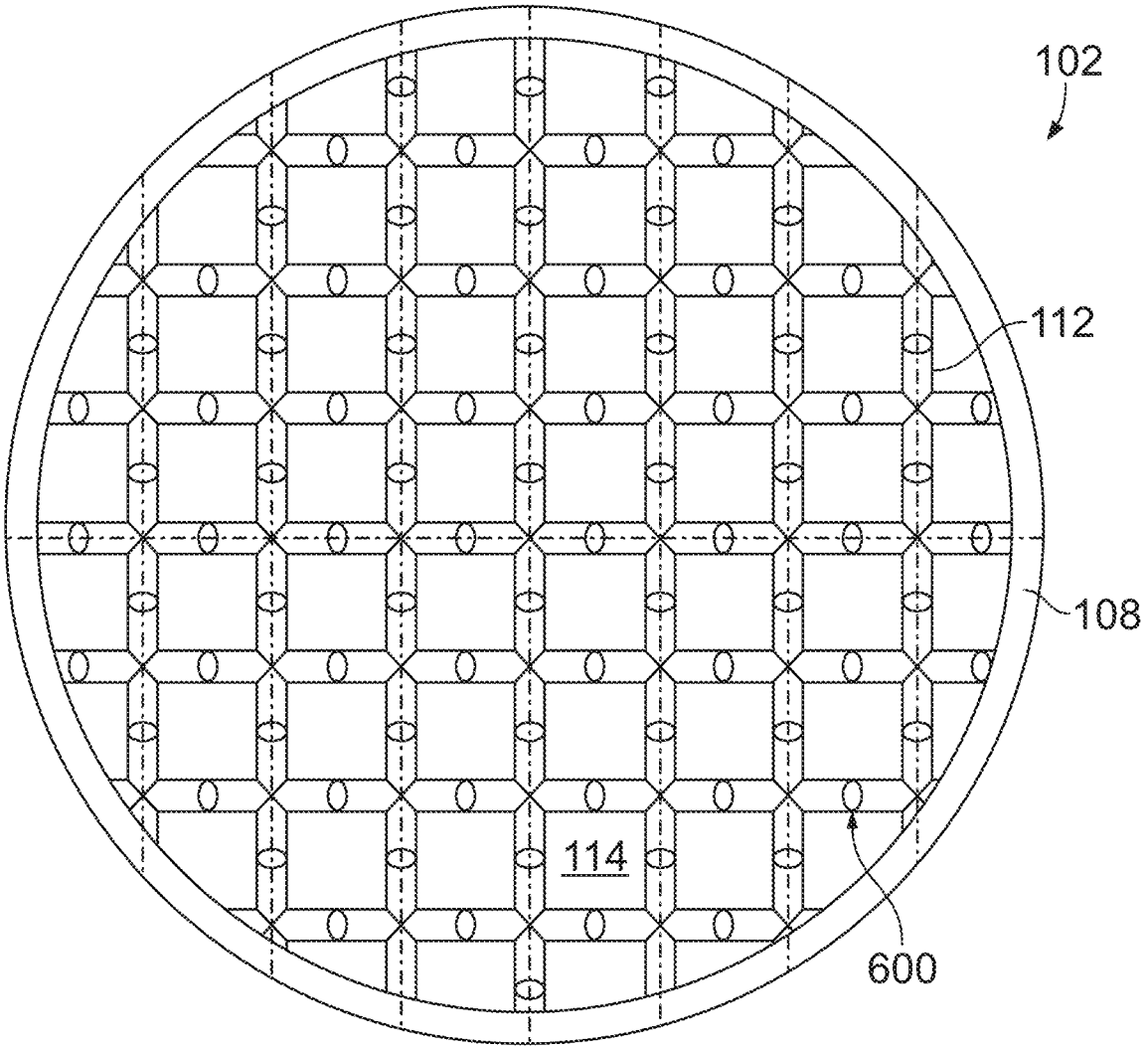
FIG. 6 illustrates a top view of another example of the top portion of the coaster shown in FIGS. 1 through 3, the coaster shown in FIG. 4, and/or the coaster shown in FIG. 5.
Figure 7:
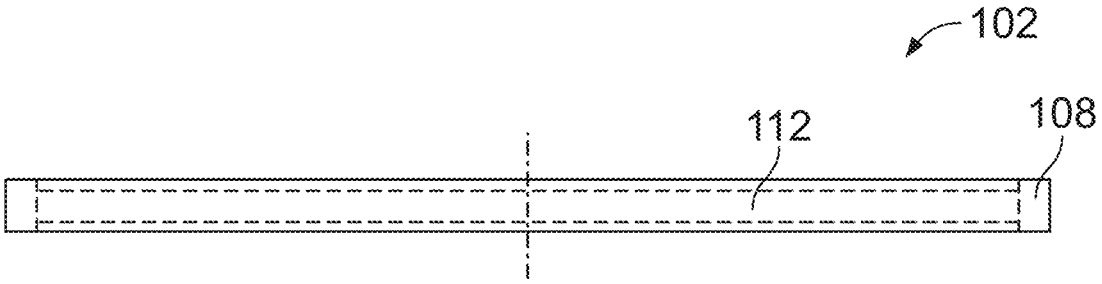
FIG. 7 illustrates an elevational view of the top portion shown in FIG. 6.
Figure 8:
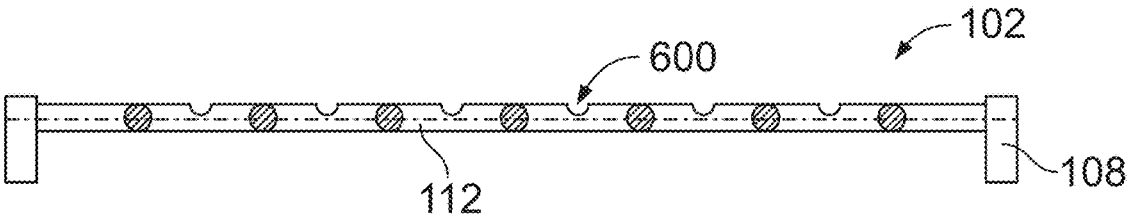
FIG. 8 illustrates a cross-sectional view of the top portion shown in FIG. 6.

FIG. 6 illustrates a top view of another example of the top portion 102 of the coaster 100 shown in FIGS. 1 through 3, the coaster 400 shown in FIG. 4, and/or the coaster 500 shown in FIG. 5. FIG. 7 illustrates an elevational view of the top portion 102 shown in FIG. 6. FIG. 8 illustrates a cross-sectional view of the top portion 102 shown in FIG. 6. The top portion 102 shown in FIG. 6 includes the linear bodies 112 arranged in the grid 110. The surface of the linear bodies 112 in the grid 110 of the top portion 102 of the coaster may include cutouts 600 extending into the linear bodies 112. These cutouts 600 form a serrated surface on which the drinking vessel can be placed. These cutouts 600 extend into the thickness of the linear bodies 112 in locations that are between intersections of the different linear bodies 112. The cutouts 600 can be semi-circular in shape, or can be semi-spherical in shape. For example, each cutout 600 can form a void or recess in the shape of part of a sphere. The cutouts 600 can be 1 millimeter diameter semi circles on approximately 12.5 millimeters centers in both the latitude and the longitude direction. These cutouts 600 create a serrated surface on which the drinking vessel or container is placed. The cutouts 600 prevent the drinking vessel from adhering to the grid 110 while placing or removing the drinking vessel. Additionally, the cutouts 600 provide a capillary effect to allow drink condensation or "sweating" to flow to the bottom collection pan of the bottom portion 104.

Figure 9:
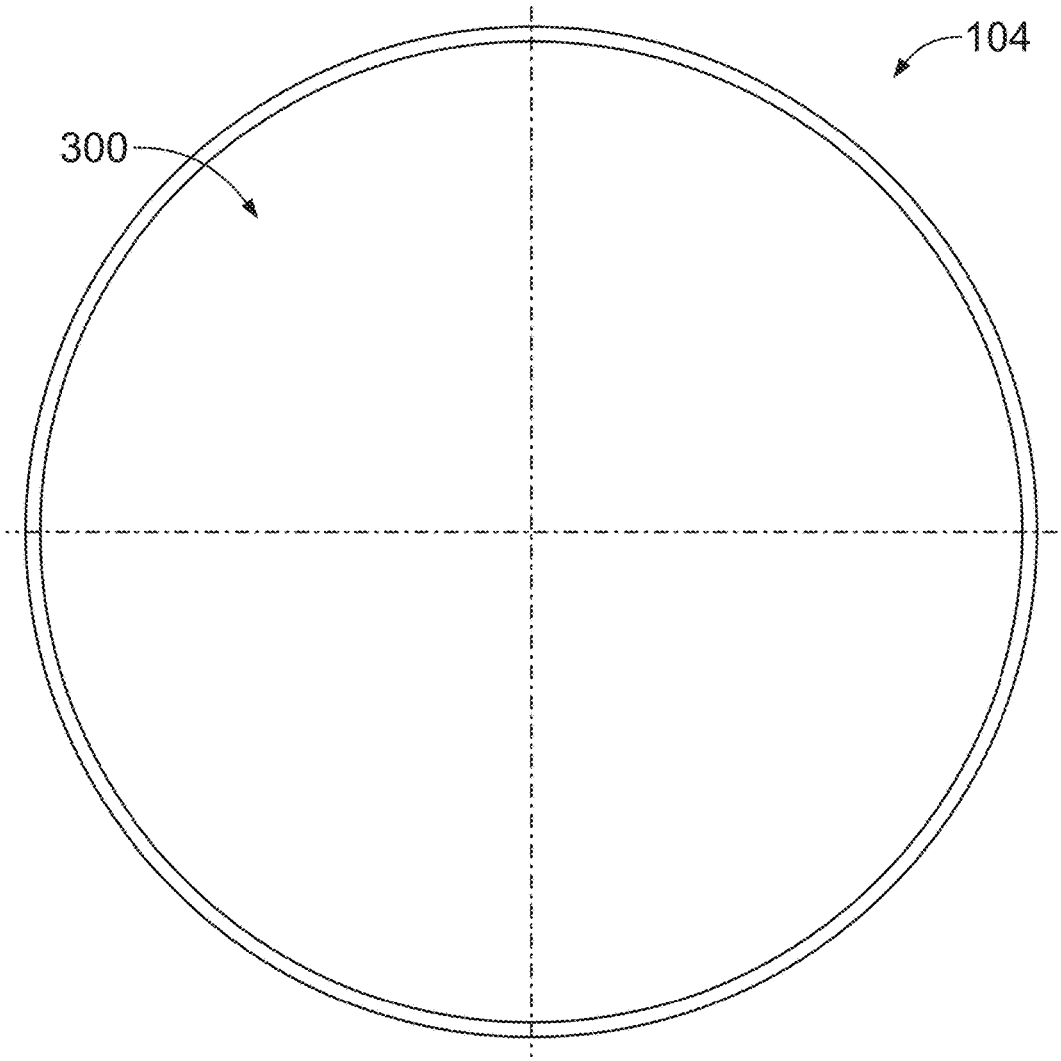
FIG. 9 illustrates a top view of the bottom portion of the coaster shown in FIGS. 1 through 3, the coaster shown in FIG. 4, and/or the coaster shown in FIG. 5.
Figure 10:
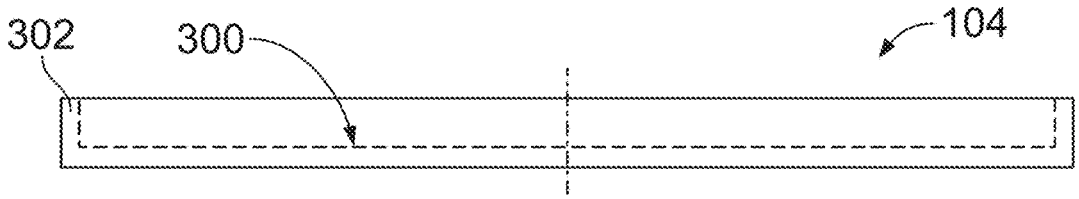
FIG. 10 illustrates an elevational view of the bottom portion shown in FIG. 9.
Figure 11:
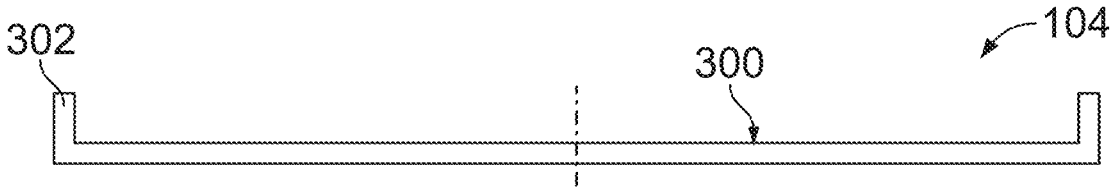
FIG. 11 illustrates a cross-sectional view of the bottom portion shown in FIGS. 9 and 10.

FIG. 9 illustrates a top view of the bottom portion 104 of the coaster 100 shown in FIGS. 1 through 3, the coaster 400 shown in FIG. 4, and/or the coaster 500 shown in FIG. 5. FIG. 10 illustrates an elevational view of the bottom portion 104 shown in FIG. 9. FIG. 11 illustrates a cross-sectional view of the bottom portion 104 shown in FIGS. 9 and 10.

FIG. 12 illustrates an elevational view of the coaster 100 according to one example. In FIG. 12, the top portion 102 shown in FIGS. 6, 7, and 8 is placed in the tray-shaped bottom portion 104 shown in FIGS. 9, 10, and 11. As shown, the top portion 102 fits entirely within the outer cylindrical wall 302 of the bottom portion 104 without projecting above the upper edge of the cylindrical wall 302. The top portion 102 may have a smaller or shorter outer or outside diameter than the diameter extending from opposing portions of the inner surfaces of the cylindrical wall 302. Moreover, the thickness of the top portion 102 may be shorter or smaller than the depth of the collection portion or volume of the bottom portion 104. For example, the distance from the top edge of the cylindrical wall 302 and the bottom wall 300 of the bottom portion 104 (measured in a direction that is perpendicular to the bottom wall 300) is at least as tall as the height or thickness of the top portion 102. This prevents the top portion 102 from projecting up above the upper edge of the cylindrical wall 302.

This can reduce the vertical profile of the coaster 100, which can be desired to reduce the risk of knocking over or spilling the drinking vessel. Additionally, placing the top portion 102 inside the bottom portion 104 can help ensure that condensate falls into the tray formed by the bottom portion 104, and not outside of the bottom portion 104 (which can occur when the top portion 102 is on top of or outside of the bottom portion 104, as condensate can flow along and fall off the outer surfaces of the top portion).

Figure 13:
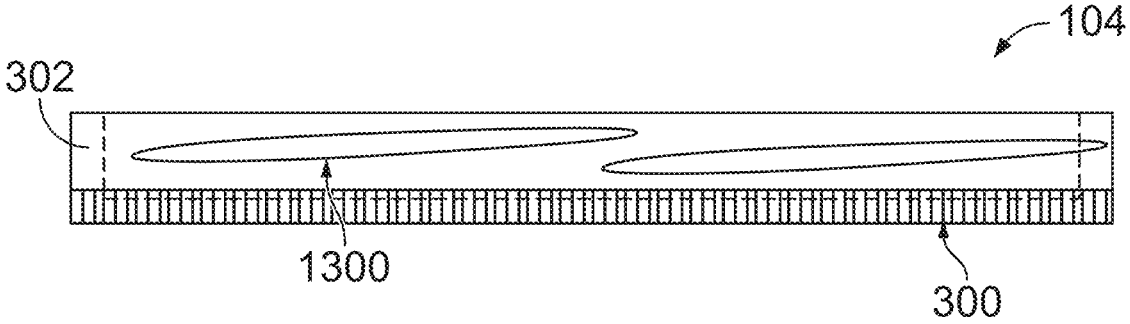
FIG. 13 illustrates an elevational view of another example of the bottom portion of the coaster shown in FIGS. 1 through 3, the coaster shown in FIG. 4, and/or the coaster shown in FIG. 5.

FIG. 13 illustrates an elevational view of another example of the bottom portion 104 of the coaster 100 shown in FIGS. 1 through 3, the coaster 400 shown in FIG. 4, and/or the coaster 500 shown in FIG. 5. In this example, the outer or exterior surface of the cylindrical wall 302 of the bottom portion 104 includes threads 1300. These threads 1300 may outwardly project from the wall 302. The top portion 102 may include internal threads along an interior surface of the cylindrical wall 108. The internal threads of the top portion 102 may mate with the threads 1300 on the bottom portion 104 by rotating the top portion 102 and/or the bottom portion 104 relative to each other. This can secure the top portion 102 to the bottom portion 104.

Figure 14:
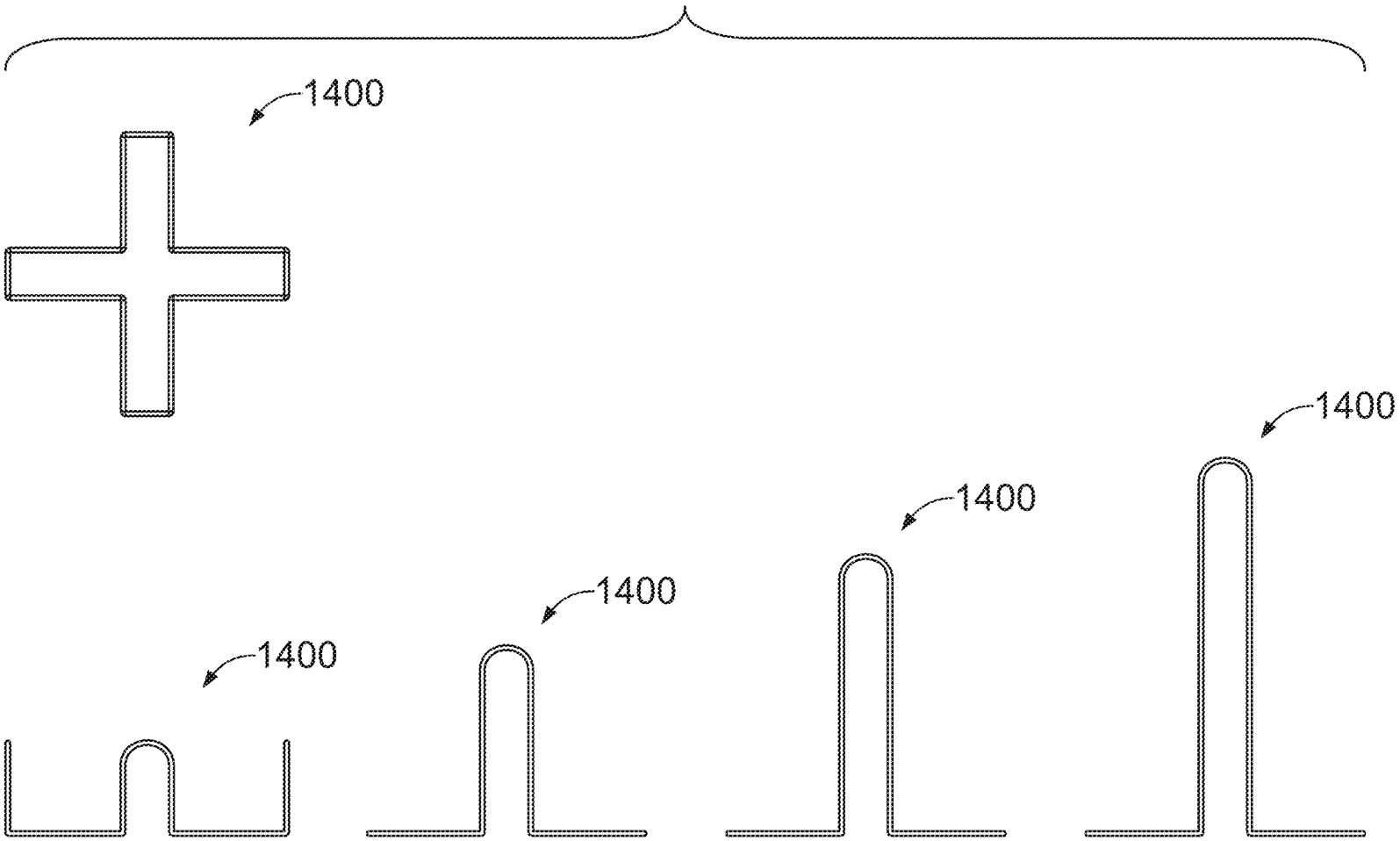
FIG. 14 illustrates views of coaster holders configured to contain one or more coasters shown and/or described herein, according to one example.

FIG. 14 illustrates views of coaster holders 1400 configured to contain one or more coasters shown and/or described herein, according to one example. The coasters may be designed to fit into 2, 4, 6 and 8 quantity coaster holder for ease of handling and storage, as shown in FIG. 14.

A method for manufacturing the coasters described herein can include forming the top portion and/or bottom portion. This forming can include molding the portion(s) from one or more polymers, additive or 3D printing the portion(s), casting the portion(s), or the like. The forming can include creating the cutouts or optionally removing sections of the linear bodies after forming to create the cutouts. If the portions are integrally formed (e.g., as a single body), then the coaster is complete. If the portions are separately formed, the portions can be combined by adhering the portions together, screwing the portions together, snap fitting the portions together, or the like.

In one embodiment, the coaster's tray-shaped bottom portion is constructed from a durable plastic material, providing a lightweight yet sturdy base for the top portion. Alternatively, the bottom portion could be made from stainless steel, offering enhanced durability and a sleek, modern appearance. The circular bottom wall may vary in diameter, accommodating different sizes of drinking vessels, while the cylindrical wall could be designed with varying heights to collect more or less condensation as needed. The top portion, which couples with or rests upon the bottom portion, might be fabricated from a heat-resistant silicone, allowing it to withstand both hot and cold temperatures without deforming. In another embodiment, the top portion could be made from a decorative wood, adding an aesthetic element to the coaster. The grid of intersecting linear bodies on the top portion could be configured with different patterns, such as a honeycomb or lattice design, to enhance the visual appeal while still allowing condensation to flow into the tray-shaped bottom portion. The spherical cutouts in the linear bodies could be replaced with other geometric shapes, such as hexagons or triangles, to provide a distinctive look while maintaining functionality. Additionally, the top portion could be designed to snap into place within the bottom portion, ensuring a secure fit that prevents accidental dislodging. These variations demonstrate the adaptability of the coaster design while remaining within the functional and legal scope of the described product.

While the embodiments shown in the Figures show coasters having circular shapes, alternatively, the coasters may have another shape, such as an oval shape (or other curved shape), a square shape (or other polygon shape), or a shape that combines lines, curves, and/or polygons.

Examples of the inventive subject matter described herein relate to a coaster designed to effectively manage moisture and provide stability for drinking vessels. The coaster comprises a tray-shaped bottom portion with a circular bottom wall and a cylindrical wall extending along its outer circumference. A top portion is configured to couple with or rest upon this bottom portion. The top portion features a grid of intersecting linear bodies, with spherical-shaped cutouts located midway between the intersections of these bodies.

This grid defines holes that allow condensation to flow into and be collected by the tray-shaped bottom portion. The top portion is sized to fit within the bottom portion, ensuring it does not protrude above the cylindrical wall.

In one variation, the top portion has an outer diameter longer than the inner diameter of the circular bottom wall. Another embodiment of the coaster includes a tray-shaped bottom portion and a top portion with a grid of intersecting linear bodies, where cutouts are formed between the intersections. These cutouts, which may be spherical, are positioned midway between the intersections and allow condensation to flow into the bottom portion. The top portion is designed to fit within the bottom portion, which includes a circular bottom wall and a cylindrical wall along its circumference. In this configuration, the top portion's outer diameter is longer than the inner diameter of the circular bottom wall, and it is shorter than the cylindrical wall.

Another example features a coaster with a top portion designed to receive a drinking vessel. This top portion includes a serrated section that engages the drinking vessel, preventing attachment when the vessel is lifted. The bottom portion is removably coupleable to the top portion and is designed to receive and store moisture. The top portion's diameter ranges between 75 millimeters and 175 millimeters, and the coaster is designed to protect furniture surfaces from temperature extremes and moisture. The top portion may include a grid surface with semi-spherical cutouts in both latitude and longitude directions, creating the serrated portion. These cutouts facilitate a capillary effect, directing moisture to a collection portion in the bottom portion, which has a volumetric capacity greater than 20 milliliters. The collection portion may include an empty bottom pan, a moisture-absorbing packet, or a color-changing absorbing packet, with the moisture-absorbing packet potentially containing silica material. The top portion can be coupled to the bottom portion via a threaded connection, snap fit, or friction fit.

While various spatial and directional terms, such as top, bottom, lower, mid, lateral, horizontal, vertical, front and the like can be used to describe embodiments of the present disclosure, it is understood that such terms are merely used with respect to the orientations shown in the drawings. The orientations can be inverted, rotated, or otherwise changed, such that an upper portion is a lower portion, and vice versa, horizontal becomes vertical, and the like.

As used herein, a structure, limitation, or element that is "configured to" perform a task or operation is particularly structurally formed, constructed, or adapted in a manner corresponding to the task or operation. For purposes of clarity and the avoidance of doubt, an object that is merely capable of being modified to perform the task or operation is not "configured to" perform the task or operation as used herein.

It is to be understood that the above description is intended to be illustrative, and not restrictive. For example, the above-described embodiments (and/or aspects thereof) can be used in combination with each other. In addition, many modifications can be made to adapt a particular situation or material to the teachings of the various embodiments of the disclosure without departing from their scope. While the dimensions and types of materials described herein are intended to define the parameters of the various embodiments of the disclosure, the embodiments are by no means limiting and are exemplary embodiments. Many other embodiments will be apparent to those of skill in the art upon reviewing the above description. The scope of the various embodiments of the disclosure should, therefore, be determined with reference to the appended claims, along with the full scope of equivalents to which such claims are entitled. In the appended claims and the detailed description herein, the terms "including" and "in which" are used as the plain-English equivalents of the respective terms "comprising" and "wherein." Moreover, the terms "first," "second," and "third," etc. are used merely as labels, and are not intended to impose numerical requirements on their objects. Further, the limitations of the following claims are not written in means-plus-function format and are not intended to be interpreted based on 35 U.S.C. § 112 (f), unless and until such claim limitations expressly use the phrase "means for" followed by a statement of function void of further structure.

This written description uses examples to disclose the various embodiments of the disclosure, including the best mode, and also to enable any person skilled in the art to practice the various embodiments of the disclosure, including making and using any devices or systems and performing any incorporated methods. The patentable scope of the various embodiments of the disclosure is defined by the claims, and can include other examples that occur to those skilled in the art. Such other examples are intended to be within the scope of the claims if the examples have structural elements that do not differ from the literal language of the claims, or if the examples include equivalent structural elements with insubstantial differences from the literal language of the claims.

What is claimed is:

1. A coaster comprising:

a tray-shaped bottom portion having a circular bottom wall and a cylindrical wall extending along an outer circumference of the circular bottom wall; and a top portion configured to couple with or rest upon the tray-shaped bottom portion, the top portion including a grid of intersecting linear bodies with semi-spherical recesses extending into the linear bodies in locations midway between intersections of the linear bodies, the linear bodies in the grid defines holes in the grid between adjacent ones of the linear bodies that are configured to allow condensation to flow into and be collected in the tray-shaped bottom portion, the top portion sized to fit within the bottom portion such that the top portion does not protrude above the cylindrical wall of the bottom portion.

2. The coaster of claim 1, wherein the top portion has an outer diameter that is longer than an inner diameter of the circular bottom wall.

3. A coaster comprising:

a tray-shaped bottom portion; and a top portion configured to couple with or rest upon the tray-shaped bottom portion, the top portion including a grid of intersecting linear bodies with semi-spherical recesses extending into the linear bodies in locations between intersections of the linear bodies.

4. The coaster of claim 3, wherein the linear bodies in the grid define holes in the grid between adjacent ones of the linear bodies that are configured to allow condensation to flow into and be collected in the tray-shaped bottom portion.

5. The coaster of claim 4, wherein each of the semi-spherical recesses are located midway between the intersections of the linear bodies.

6. The coaster of claim 3, wherein the top portion is sized to fit within the bottom portion.

7. The coaster of claim 6, wherein the bottom portion includes a circular bottom wall and a cylindrical wall extending along an outer circumference of the circular bottom wall.

8. The coaster of claim 7, wherein the top portion has an outer diameter that is longer than an inner diameter of the circular bottom wall.

9. The coaster of claim 8, wherein the top portion is shorter than the cylindrical wall of the bottom portion.

10. A coaster, comprising:

a top portion configured to receive a drinking vessel, the top portion including a serrated portion configured to engage the drinking vessel; and a bottom portion configured to be removably coupleable to the top portion, the bottom portion configured to receive and store moisture from the drinking vessel, wherein the top portion includes a grid surface including semi-spherical recesses in both a latitude and a longitude direction to create the serrated portion.

11. The coaster of claim 10, wherein the serrated portion is configured to prevent attachment of the drinking vessel to the coaster responsive to the drinking vessel being raised.

12. The coaster of claim 10, wherein the top portion has a diameter between 75 millimeters and 175 millimeters.

13. The coaster of claim 10, where the coaster is designed to protect a furniture surface by protecting the furniture surface from hot or cold temperatures of the drinking vessel and ensuring the moisture does not contact with the furniture surface.

14. The coaster of claim 10, wherein the semi-spherical recesses are configured to cause a capillary effect to allow the moisture to flow to a collection portion of the bottom portion.

15. The coaster of claim 14, wherein the collection portion is configured to have a volumetric capacity of greater than 20 milliliters.

16. The coaster of claim 14, wherein the collection portion may include one or more of: an empty bottom pan, a moisture absorbing packet, or a color changing absorbing packet.

17. The coaster of claim 16, wherein the moisture absorbing packet includes a silica material.

18. The coaster of claim 10, wherein the top portion is configured to be coupled to the bottom portion via one or more of a threaded connection, a snap fit, or a friction fit.

19. The coaster of claim 1, wherein the tray-shaped bottom portion is configured to have a volumetric capacity of greater than 20 milliliters.

20. The coaster of claim 1, wherein the top portion is configured to be coupled to the tray-shaped bottom portion via a threaded connection.

* * * * *